US005727120A

United States Patent [19]

Van Coile et al.

[11] Patent Number: 5,727,120

[45] Date of Patent: Mar. 10, 1998

[54] APPARATUS FOR ELECTRONICALLY GENERATING A SPOKEN MESSAGE

[75] Inventors: Bert Van Coile; Stefaan Willems, both of Sint-Andries; Steven Leys, Drongen, all of Belgium

[73] Assignee: Lernout & Hauspie Speech Products N.V., Belgium

[21] Appl. No.: 725,881

[22] Filed: Oct. 4, 1996

Related U.S. Application Data

[62] Division of Ser. No. 379,330, Jan. 26, 1995, Pat. No. 5,592,585.

[51] Int. Cl.[6] ..... G10L 3/02; G10L 9/00; G10L 5/02

[52] U.S. Cl. ..... 395/2.15; 345/2.67; 345/2.69; 345/2.76

[58] Field of Search ..... 395/2.15, 2.16, 395/2.17, 2.67, 2.69, 2.75, 2.76

[56] References Cited

U.S. PATENT DOCUMENTS

| | | | |
|---|---|---|---|
| 4,412,099 | 10/1983 | Niyada et al. | 395/2.67 |
| 4,908,867 | 3/1990 | Silverman | 395/2.67 |
| 5,384,893 | 1/1995 | Hutchins | 395/2.76 |
| 5,615,300 | 3/1997 | Hara et al. | 395/2.69 |
| 5,617,507 | 4/1997 | Lee et al. | 395/2.09 |

OTHER PUBLICATIONS

E. Moulins et al., "New Approaches For Improving The Quality text–to–speech". Proceedings of Verba 90, International Conference of Speech Technologies, Roma, 22–24, Jan., 19909, pp. 310–319.

*Primary Examiner*—Allen R. MacDonald
*Assistant Examiner*—Patrick N. Edouard
*Attorney, Agent, or Firm*—Bromberg & Sunstein LLP

[57] ABSTRACT

An improved apparatus for generating a spoken message is of the type formed by (i) first recording speech and (ii) then utilizing the recording so as to obtain at least one carrier, each carrier having at least one fixed part and at least one open slot, and then (iii) inserting an argument into each open slot. The improvement provides a phonetico-prosodic parameter generator for characterizing the message in terms of a sequence of phonetico-prosodic parameters for each carrier. An electronic memory stores the phonetico-prosodic parameters corresponding to each carrier and a controller constructs sequences of phonetico-prosodic parameters corresponding to the argument of each open slot. From the phonetico-prosodic parameters, a phonetics-to-speech converter generates a digital sound wave pattern which is converted, by a D/A converter, into an analog sound wave pattern. An output unit provides audible sound waves corresponding to the analog sound wave pattern. In a preferred embodiment, an input is provided for entering the arguments as orthographic or phonetic text which is converted to phonetico-prosodic parameters as well, so that the entire spoken message can be synthesized by a phonetics-to-speech system, resulting in enhanced consistency, even when the carriers are generated from the recording of different human subjects.

3 Claims, 3 Drawing Sheets

APPARATUS FOR ELECTRONICALLY GENERATING A SPOKEN MESSAGE

This application is a divisional application of Ser. No. 08/379,330, filed Jan. 26, 1995, incorporated herein by reference now U.S. Pat. No. 5,592,585.

FIELD OF THE INVENTION

This invention relates to a apparatus for electronically generating phonetico-prosodic parameters for a message and also to a apparatus for generating a spoken message using the generated phonetico-prosodic parameters.

For the sake of clarity, the terminology used in this application is explained in a glossary at the end of the description.

BACKGROUND OF THE INVENTION

Methods for electronically generating spoken messages are known from, for example, car navigation systems, phone banking systems and flight information systems. These systems are all capable of generating a number of messages having a fixed part combined with variable information.

Consider for example a phone banking system. Such a system supplies to the user a spoken message indicating the balance of his bank account. For example: "Your bank account presents a balance of two thousand three hundred and fifteen dollars." The fixed part in the message of the example is: "Your bank account presents a balance of <NR> dollars." <NR> indicates the position of an open slot, i.e. a placeholder for information that varies over messages. In this case <NR> has been filled with the numeral 2,315. In general <NR> will be filled with a numerical argument corresponding to the user's bank account. It is clear that this numerical argument will vary from one message to the other.

Such a system operates by concatenating chunks of recorded digitized speech. In the above example, the following chunks could have been recorded and stored:

Your bank account presents a balance of two thousand three hundred and fifteen dollars At run time, the announcement system could then read these chunks from memory and concatenate them to form a composite waveform representing in digitized form the spoken equivalent of the message. An audible speech signal can then be produced when this composite waveform is processed to a digital-to-analog converter and fed to a loudspeaker.

The drawbacks of the known method are that:

The resulting speech output tends to sound unnatural due to the concatenation of separately recorded speech chunks.

For speech output to sound homogeneous, all speech chunks need to be recorded with the same speaker. This implies that unavailability of the speaker for additional recordings may mean recording the whole set all over with a different speaker.

Since such announcement systems can only playback recorded speech, open slots can only be filled with arguments that have been recorded on beforehand. New recordings are necessary for any new information to be read out.

An object of the present invention is to provide a method for electronically generating a spoken message in such a manner that said message sounds homogeneous and has a highly natural character.

Another object of the invention is to provide a method for electronically generating a spoken message which is not speaker dependent.

SUMMARY OF THE INVENTION

According to a preferred embodiment of the invention, an improved apparatus for generating a spoken message is provided, of the type employing a recording of the message spoken by a human voice, wherein the recording is parsed into at least one carrier, each carrier having at least one fixed part and at least one open slot, and an argument is inserted into each open slot. The improved apparatus has a phonetico-prosodic parameter generator for characterizing the message in terms of phonetico-prosodic parameters and an electronic memory for storing phonetico-prosodic parameters corresponding to each carrier. A controller constructs sequences of phonetico-prosodic parameters corresponding to the argument of each open slot, whereupon a phonetics-to-speech converter generates a digital sound wave pattern from the sequences of phonetico-prosodic parameters. Additionally, a D/A converter is provided for generating an analog sound wave pattern from the digital sound wave pattern. Finally, an output unit provides audible sound waves corresponding to the analog sound wave pattern.

In an alternate embodiment of the invention, the apparatus for electronically generating a spoken message has, additionally, an input device for reading the arguments in orthographic or phonetic text format.

In a further alternate embodiment of the invention, an improved apparatus for generating a spoken message is again provided, of the type employing a recording of the message spoken by a human voice, wherein the recording is parsed into at least one carrier, each carrier having at least one fixed part and at least one open slot, and an argument is inserted into each open slot. The improved apparatus has a first controller for selecting those carriers composing the message to be generated. An identifying means assigns identifiers to the selected carriers and an electronic memory stores phonetico-prosodic parameters corresponding to each carrier. A second controller is provided for constructing sequences of phonetico-prosodic parameters corresponding to the argument of each open slot, whereupon a phonetics-to-speech converter generates a digital sound wave pattern from the sequences of phonetico-prosodic parameters. Additionally, a D/A converter is provided for generating an analog sound wave pattern from the digital sound wave pattern. Finally, an output unit provides audible sound waves corresponding to the analog sound wave pattern.

The present invention uses phonetico-prosodic parameters as input for a phonetics-to-speech (PTS) system to produce in real time highly natural sounding speech output. The achieved naturalness is comparable with that of recorded speech, while the memory requirements needed to store phonetico-prosodic parameters are very low.

For the carriers, i.e. the fixed parts of the messages, the phonetico-prosodic parameters are generated beforehand by means of prosody transplantation and stored in a data base. According to another aspect of the invention, open slots may be filled with arbitrary arguments. No new recordings are required since for the arguments filled in the open slots an phonetico-prosodic parameters is calculated at run time.

At run time, the system of this invention retrieves the phonetico-prosodic parameters for the carrier from memory and integrates it with the phonetico-prosodic parameters for the arguments generated at run time. The resulting composite phonetico-prosodic parameters is then fed to a phonetics-to-speech system, which converts it into a digitized speech signal.

By application of the method according to the invention each synthesized message sounds highly natural. Optimal prosody is obtained by two factors:

The system stores the fixed parts of a message as EPT resulting from an off-line prosody transplantation. This transplantation is based on a recording of the same message (with filled in open slots) spoken by a speaker.

For the arguments in the open slots the invention computes an EPT at run time. This can be done taking characteristics of the carrier into account, in such a way that the synthesized arguments match with the carrier, and the combined result forms a homogeneous sounding message.

DETAILED DESCRIPTION AND PREFERRED EMBODIMENTS

Figure 1:
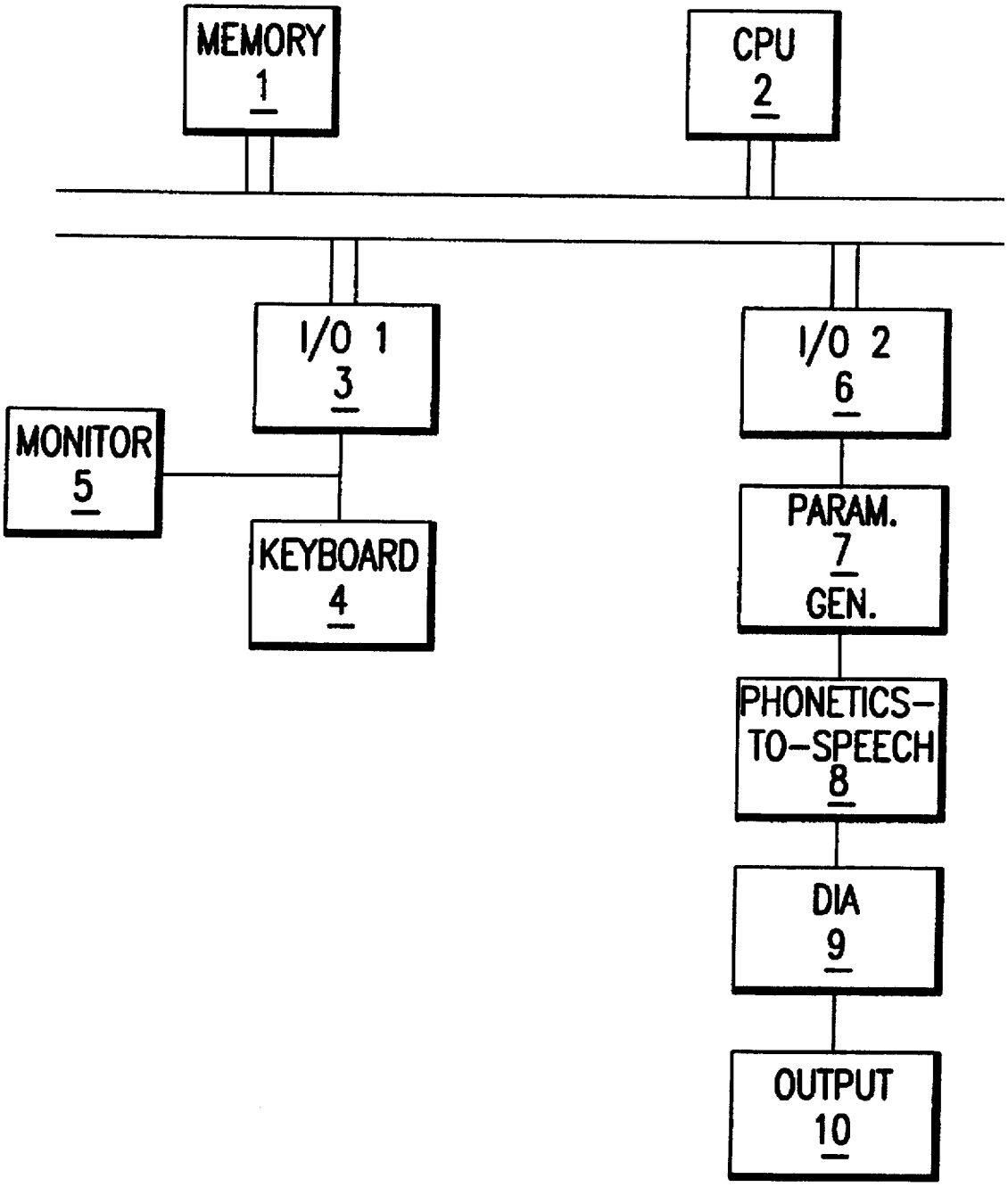
FIG. 1 is a schematic representation a device for electronically generating a spoken message according to a method according to the invention.

Methods for transforming text into speech are already known as text-to-speech (TTS) systems, described in the article of E. Moulins, C. Sorin, F. Charpentier, entitled: "New approaches for improving the quality of text-to-speech systems", published in Proceedings of the "Verba 90" International Conference on Speech Technologies, Roma, 22–24 Jan. 1990, pp. 310–319. The overall architecture of any TTS system can be described as a two-level structure: the first level transforms text into phonetico-prosodic parameters by using linguistic and prosodic modules, the second level transforms the formed phonetico-prosodic parameters into speech by using phonetics-to-speech systems.

In the development of text-to-speech systems, prosody tranplantation is sometimes used to generate phonetico-prosodic parameters starting from a recording of a fixed message spoken by a human voice. Because the thus obtained phonetico-prosodic parameters are used as reference data to evaluate the linguistic and prosodic modules of these text-to-speech systems, they are never decomposed into fixed parts and arguments.

According to the invention, phonetico-prosodic-parameters are extracted from recording of a human voice speaking a message comprising at least one carrier, by means of a prosody transplantation technique. A sequence of phonetico-prosodic parameters for each carrier is thus obtained. In this sequence, sections of phonetico-prosodic parameters corresponding to arguments will be identified and substituted by open slot data comprising information of the open slots of the carrier; the thus obtained sequences with an assigned identifier will be stored in a memory.

The carrier is retrieved from the memory. Arguments to be filled in in the open slots are supplied and transformed into phonetico-prosodic parameters using prosodic modules of a TTS system and taking into account said information. Phonetico-prosodic parameters of the entire carrier are now generated and input into a PTS system, which transforms the phonetico-prosodic parameters of the entire message into speech.

A message is generally composed of carriers and phrases. A carrier comprises at least one fixed part and at least one open slot in which an argument has to be filled in, while a phrase only comprises a fixed part. Of course the message can comprise only carriers and no phrases. It is important to realize that for a given application the phrases and carriers have to be defined on beforehand, because they have to be stored in a memory.

The method according to the invention can best be understood starting from an example given hereunder. Consider an announcement system in a railway station. This announcement system produces messages indicating the destination of a leaving train as well as the track it is leaving from. However, the destination and the track will be different from announcement to announcement. The destination and the track will therefore be variable parts or open slots of the message, to be filled with arguments. The remaining part of the message is fixed.

Suppose now that the following messages are generated:

1. "May I have your attention, please. The next train for Boston is now leaving on track 7. Smoking is not permitted on this train."
2. "May I have your attention, please. The next train for New York is now leaving on track two. Please have your tickets ready."

These messages comprise the following carriers and phrases:

"The next train for <LOCATION> is now leaving from track <NUMBER>.",

"May I have your attention, please.",

"Smoking is not permitted on this train.",

"Please have your tickets ready.".

In the considered example, <LOCATION> and <NUMBER> are open slots and the remaining parts are fixed. In <LOCATION> the name of the destination has to be inserted (e.g. Boston, New York), while in <NUMBER> the track number has to be filled in (e.g. 7, 2).

According to the present invention, carriers and phrases are stored in a memory. Suppose for example that the following carrier has to be stored: "The next train for <LOCATION> is now leaving from track <NUMBER>." In order to record this carrier, arguments are inserted in the open slots <LOCATION> and <NUMBER>, for example "New York" and "5". A recording of "The next train for New York is now leaving from track 5." spoken by a human voice is thereupon made.

To said recording, a known technique called prosody transplantation is applied. This technique is described in the article by B. Van Coile, A. DeZitter, L. Van Tichelen and A. Vorstermans, entitled: "Prosody Transplantation in Text-To-Speech: Applications and Tools", published in Conference Proceedings of the second ESCA/IEEE Workshop on Speech Synthesis, New York, 12–15 Sep. 1994, pp. 105–108. This article explains that by application of prosody transplantation, phonetic transcription, phoneme durations and intonation contour of a recording are extracted. Phonetic transcription, phoneme durations and intonation contour are three components which together are Called enriched phonetic transcription of the recording, and will be described later. With this technique, also other speech characteristics can be extracted from a recording, such as for example the amplitude of the recorded sounds. The extracted information is called phonetico-prosodic parameters, as described by E. Moulins, C. Sorin and F. Charpentier in their article "New approaches for improving the quality of text-to-speech systems", published in Proceedings of the "Verba 90" International Conference on Speech Technologies, Rome, 22–24 Jan. 1990, pp. 310–319.

By applying a prosody transplantation technique to said recording, a sequence of phonetico-prosodic parameters for each carrier is obtained.

When prosody transplantation has been applied, sections of phonetico-prosodic parameters corresponding to said arguments are identified. In the example the sections of phonetico-prosodic parameters corresponding to <LOCATION> and <TRACK> are thus identified.

These sections are substituted by open slot data comprising at least position information indicating the position of the open slots.

Further, an identifier is assigned to each thus obtained sequence, for example 21. The obtained sequence with its identifier is then stored in memory.

As mentioned hereinabove, enriched phonetic transcription comprises three components: phonetic transcription, phoneme durations and intonation contour.

Phonetic transcription specifies the sounds of said fixed parts, respectively said phrase, to be spoken and is represented by Symbols, each symbol corresponding to one phoneme. A phoneme is a unit of a spoken language in the same way that a letter is a unit of a written language. For example the word "schools" contains 7 letters in the written language, whereas in the spoken language/skulz/contains 5 phonemes.

Phoneme durations define for each phoneme of the phonetic-transcription the number of milliseconds said phoneme has to last.

Figure 3:
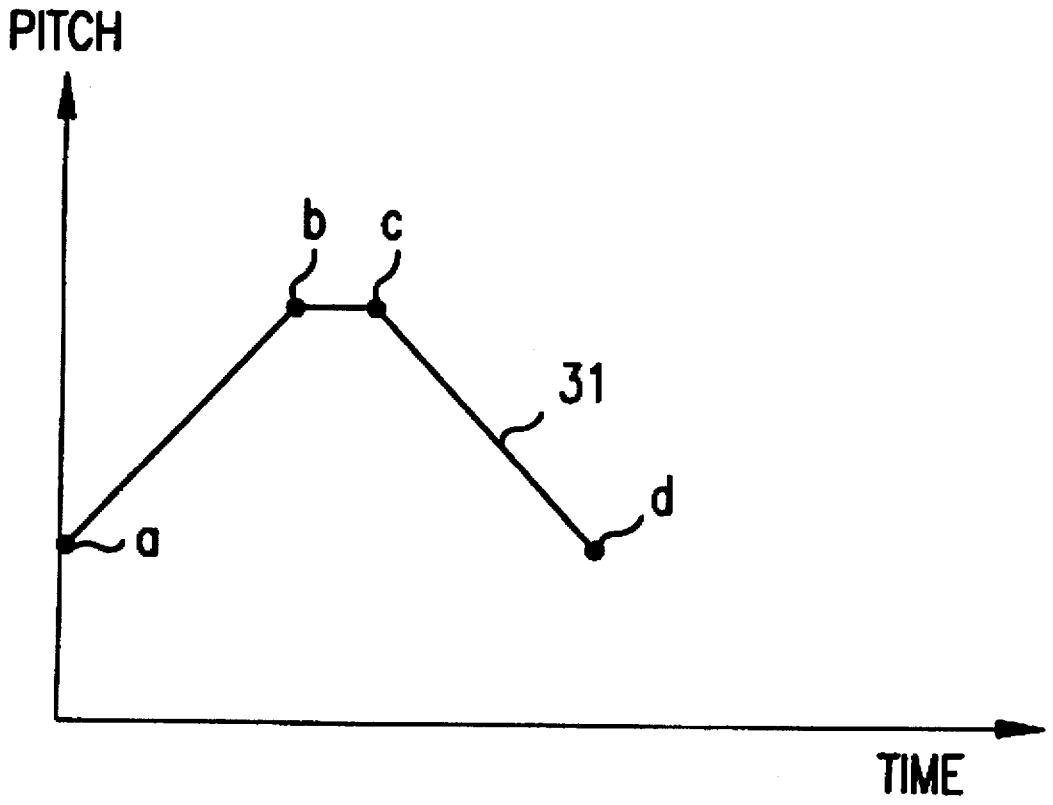
FIG. 3 is a representation of a pointed hat intonation model.

Intonation contour specifies the melody of an utterance as a piece-wise linear curve which is defined by a number of breakpoints. This is a model of the variation of the pitch over the utterance. Each breakpoint implies that the melody has to achieve a given pitch level at a given time. In between two breakpoints the pitch has to vary linearly between the breakpoints— pitch. An example of an intonation contour is a pointed hat and is shown as item 31 in FIG. 3. In FIG. 3,it can be seen that at point a, the utterance starts at a given pitch, then raises linearly with time to a second pitch at point b; this is maintained to point c, and then the pitch decreases linearly with time until point d,is reached which is at the same pitch as point a.

Each carrier comprises at least position information indicating the position within said carrier of each of its open slots. It could also comprise additional information of at least one of its open slots, used for generating the phonetico-prosodic parameters of the arguments, such as lexical information of the open slot, syntactical information of the open slot, intonation model of the open slot.

The intonation model of the open slot describes the intonation contour to be generated on the open slot, for example a pointed hat.

Lexical information of the open slot specifies if the argument is a for example a noun, a number or a verb.

Syntactical information of the open slot in the message can specify wether or not the open slot is situated at the end of a sentence, and also whether or not it is situated at a syntactical boundary. In the example <LOCATION> is not situated at the end of a sentence, but is at a syntactical boundary, since it is the last word of the subject of the sentence. <NUMBER>, being the last word of an adverbial adjunct of place, is therefore situated at a syntactical boundary and is also situated at the end of the sentence.

Above mentioned carrier: "The next train for <LOCATION> is now leaving from track <NUMBER>." could correspond to a sequence of phonetico-prosodic parameters, for example represented by the following EPT sequence:

```
#[22(0,105)]D[74]$[82]–n[92(32,104)]E[88]
k[69(2,118)(12,118)]s[100(93,101)]–t[85]r[29]J[102]
n[60]–f[81]o[92]r[46(46,96)]<LOCATION : h, NNY>?[70]
I[52]z[61]–n[79(19,91)]@[148(90,106)]–1[70]I[91]–v[67]
I[51]N[87]–?[70]a[93]n[55]–t[54]r[29]æ[71]k[50(50,99)]
<NUMBER : a, QYY>#[22]
```

whereby each symbol corresponds to one phoneme and the values between the square brackets give information about phoneme durations and intonation contour.

The first value between square brackets is the phoneme duration (in ms). It may be followed by one or more intonation breakpoints between round brackets. Each breakpoint consists of a time offset (in ms) relative to the beginning of the phoneme, followed by a pitch value (in quarter semitones above 50 Hz).

Said position information is given by the position of the open slots in said EPT representation. In the given example of the carrier, the position of <LOCATION> and <NUMBER> in the EPT representation constitutes said position information.

Additional information of the open slots is also represented. For example in <LOCATION: h, NNY>, h means that the intonation model is a pointed hat, NNY indicates that the slot is to be filled by a noun (N for noun), that the slot is not situated at the end of a sentence (N for no), but that it is situated at a syntactical boundary (Y for yes).

To phrases a prosody transplantation technique is likewise applied in order to obtain a further sequence of phonetico-prosodic parameters for said phrases. To each further sequence a further identifier is assigned, and the thus obtained further sequence with its further identifier is stored in said memory.

A device for generating a spoken message according to the present invention is shown in FIG. 1. This device comprises the following components, connected to a bus:a memory 1, a CPU 2, a first I/O unit 3, to which a keyboard 4 and a monitor 5 are connected and a second I/O unit 6. The device further comprises a phonetico-prosodic parameters generator 7, a phonetics-to-speech system 8 a D/A converter 9 and an output unit 10.

All the phrases and carriers of an announcement system are stored in a memory 1 as explained hereinabove.

According to the invention, a method for generating phonetico-prosodic parameters of said message comprises the following steps, which will be illustrated by using the following example. Suppose a user of the announcement system has to generate the following message. "May I have your attention, please. The next train for Boston is now leaving on track 7. Smoking is not permitted on this train."

The user selects at least one carrier and if necessary at least one phrase. In the example he selects carrier "The next train for <LOCATION> is now leaving from track <NUMBER>." and phrases "May I have your attention, please." and "Smoking is not permitted on this train.", having as their identifiers respectively 21, 22 and 23.

Further, the user addresses the selected carrier and phrases by means of their identifiers. According to the example, he selects 21, 22 and 23. This selection could for example be achieved by entering these identifiers by means of a keyboard 4, as represented in the device of FIG. 1. The selected phrases and carriers appear on a monitor 5.

The device retrieves the addressed carrier and phrases from said memory 1, for example when the user hits the enter key on said keyboard 4.

The device asks the user to supply the arguments to be filled in in the open slots of the carrier, in this case the <LOCATION> and the <NUMBER>. The user can supply the arguments in orthographic or phonetic form. Suppose that he chooses for the orthographic form. Then he will supply: "Boston" and "7" by means of the keyboard 4.

After having been supplied with the arguments, a phonetico-prosodic parameters generator 7 will generate phonetic transcription, phoneme durations and intonation contour of said arguments starting from the supplied form. In case the argument has been supplied in phonetic form, the phonetico-prosodic parameters generator 7 will only have to generate phoneme durations and intonation contour of said arguments. More details of this phonetico-prosodic parameters generation will be described with reference to the flow chart represented in FIG. 2.

Once generated, said phonetico-prosodic parameters of said arguments are filled in in the assigned open slots. In the example the phonetico-prosodic parameters for "Boston", respectively "7" are filled in in the open slots.<LOCATION>, respectively <NUMBER>.

At this point, the phonetico-prosodic parameters of each carrier and phrase have been generated. Said carriers and phrases are concatenated forming the phonetico-prosodic parameters of the entire message. These phonetico-prosodic parameters are then supplied to a known phonetics-to-speech system 8 (described in the article by E. Moulins, C. Sorin and F. Charpentier: "New approaches for improving the quality of text-to-speech systems", published in Proceedings of the "Verba 90" International Conference on Speech Technologies, Rome, 22–24 Jan. 1990, pp. 310–319), which will convert phonetico-prosodic parameters into a digital speech signal. This digital speech signal is then supplied to a D/A converter 9, providing a signal, which is supplied to an output device 10, comprising an amplifier and at least one loudspeaker, which will output the message.

Figure 2:
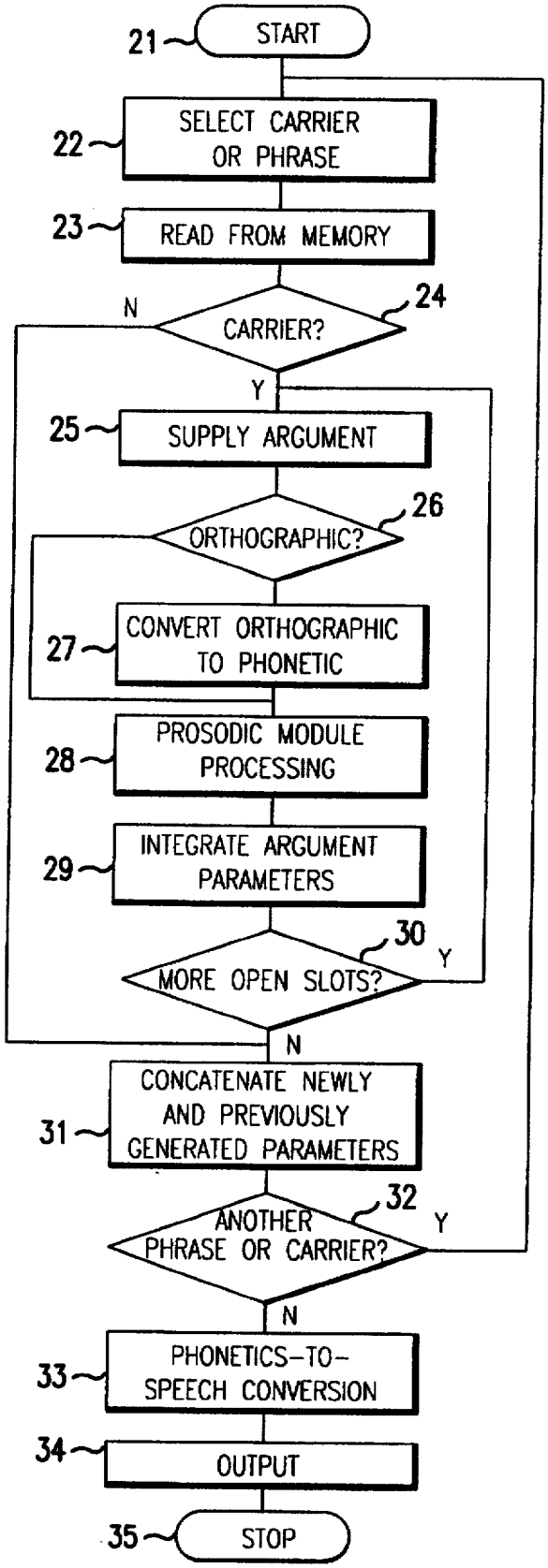
FIG. 2 represents a flow chart of a method according to the invention.

The method for electronically generating a spoken message, according to the invention will now be illustrated by means of the flow chart represented in FIG. 2. The different steps of the speech generation routine represented by the flow chart of FIG. 2 will now be explained

21. STR: The speech generation routine is started up when the user starts the device.

22. SID: The user selects one carrier or one phrase, and addresses it by means of its identifier with keyboard 4.

23. RDM: When the enter key is hit on said keyboard 4, said carrier or phrase is read from memory 1 and the sequence is supplied to the second I/O device 6.

24. C?: In this step the system checks whether the sequence is a carrier or a phrase.

25. SAR: The argument to be filled in the next open slot is supplied in orthographic or phonetic transcription by means of keyboard 4.

26. 0?: This step checks whether the argument is supplied in orthographic form or in phonetic transcription.

27. COP: The argument in orthographic form is converted into a phonetic transcription with a known grapheme-to-phoneme conversion technique.

28. MOD: The phonetico-prosodic parameters of the fixed parts of the carrier, the open slot data and the phonetic transcription of the argument are supplied to prosodic modules in order to generate phonetico-prosodic parameters, and more particularly phoneme durations and intonation contour of the arguments. Prosodic modules are known from TTS systems, as described in VERBA90

. . .

Such prosodic modules may be software routines which return phoneme durations and intonation contour when supplied with the phonetico-prosodic parameters of the fixed part of said carrier and the phonetic transcription of the arguments to be filled in in its open slots. In case that said carrier comprises said additional information of said open slot, this additional information will be taken into account by said prosodic modules.

An example of software routines will now be described.

A routine CalcArgPhonemeDurations, used to generate phoneme durations, may be an implementation of a durational model described in literature, e.g. From text to speech, the MiTalk system, J. Allen, M. S. Hunnicutt, D. Klatt, Cambridge University Press 1987, pp. 93.

This durational model consists of a set of rules that assign a duration to each phoneme of a phonetic transcription according to the formula: DUR=((INHDUR−MINDUR)× PRCNT)+MINDUR where INHDUR is the inherent duration of the phoneme in milliseconds, MINDUR is the minimal duration of the phoneme in milliseconds, and PRCNT is the percentage shortening determined by applying a number of rules. The inherent and minimal duration of each phoneme of the language are fixed values, which are stored in memory. Each of the rules modifies under certain conditions the PRCNT value, which is initially 100%, obtained from the previous applicable rules by an amount PRCNT1, according to the equation: PRCNT=(PRCNT× PRCNT1)/100

For example, the phoneme a in/bas-t$n/has an inherent duration of 160 ms and a minimal duration of 100 ms. Rule 3 of the durational model states that a phoneme which is a vowel, and which does not occur in a phrase-final syllable, is shortened by PRCNT1=60. The conditions of this rule are met, so CalcArgPhonemeDurations will change PRCNT into 60%.

Remark that the routine has to know whether or not the syllable is phrase-final, i.e. occurring just before a syntactical boundary, to be able to apply this rule. To figure this out it may use the prosodic parameters NNY of the open slot description <LOCATION: h, NNY> indicating that the <LOCATION> slot comes just before a syntactical boundary.

Rule 4 of the durational model states that a phoneme which is a vowel, and which does not occur in a word-final syllable, is shortened by PRCNT1=85. Thus, PRCNT becomes 60×0.85=51%.

Finally, the last rule which influences the outcome, is rule 5 of the durational model stating that a phoneme which is a vowel, and which occurs in a polysyllabic word, is shortened by PRCNT1=80. Thus, PRCNT is converted into 51%× 0.80=41%. Using this value the duration of the phoneme a is calculated as (160−100)×41%+100=124. ms.

However, this is only one of the many implementations of CalcArgPhonemeDurations. Other and less complicated implementations for generating phoneme durations without requiring open slot data are known.

A routine CalcArgIntonationContour, used for generating an intonation contour, may be implemented as follows. Assume it has at its disposal a list with the definitions of intonation movements of the language. Then the routine has the knowledge that a given intonation movement is represented by a given symbol, and is composed of a given number of breakpoints that are positioned in a given manner relative to a reference time. The reference time is usually set to the onset of the vowel of the stressed syllable. The h movement (h is one of the prosodic parameters of the <LOCATION> slot) may be specified as (exc=+16, t=−60, dur=150)+(exc=−16, t=100, dur=150). Each of the units between round brackets defines two breakpoints, exc being the difference in pitch level between the two breakpoints, t being the time offset, relative to a reference time, of the first breakpoint, and dur being the time interval between the two breakpoints. So the h movement, which is a combination of two units, will have four breakpoints in total.

Based upon this definition of the h movement and the last pitch value 96 in the carrier before the <LOCATION> open slot, the routine CalcArgintonationContour calculates the four breakpoints as (−60, 96)(−60+150, 96+16)(100, 96+16)(100+150, 96+16−16). Finally, it should relate these breakpoints to the vowel of the stressed syllable i.e. the a in/bas-t$n/.

At this point the phonetico-prosodic parameters of the entire message are generated.

29. INT: The phonetico-prosodic parameters of the argument are integrated in the assigned open slot.

30. OS?: There is checked if there is a subsequent open slot in the carrier.

31. CON: The generated phonetico-prosodic parameters of the carrier is concatenated with the already generated sequence, if any.

32. +P/C?: In this step, the system checks if there is another phrase or carrier to be processed.

33. PTS: The phonetico-prosodic parameters of the entire message are fed to a known phonetics-to-speech system, which will convert them into digital speech signal.

34. OUT: Said digital speech signal is then output as explained hereinabove.

35. STP: This terminates the speech generation routine.

Alternative embodiments can comprise the following modifications with respect to the described embodiment.

The message can comprise only one carrier or at least two carriers, and can possibly further comprise at least one phrase. If the message comprises only one carrier, there will of course be no concatenation.

The addressing of carriers, respectively phrases could be achieved by another user interface, for example a touch screen, by touching the selected carriers respectively phrases which appear on a menu in a screen, or a voice recognition system.

In the example of a station, the train could send a signal to the device in such a manner that all the input to the device is automatically generated.

GLOSSARY argument

A slot filler which substitutes an open slot of a carrier at run time.

carrier

A message unit with open slot.

enriched phonetic transcription

A phonetic transcription of an utterance enriched with information specifying the speech rhythm and melody of the utterance. An enriched phonetic transcription models a spoken utterance not taking into account voice characteristics such as timbre, nasality and hoarseness.

EPT

Enriched phonetic transcription.

intonation contour

Piece-wise linear curve which specifies the melody of an utterance.

open slot

Formal parameter of a carrier. It is a placeholder that can take a piece of information that may vary over several messages. By filling the open slot with different values several variants can be derived from the same carrier.

orthographic transcription

The spelling of an utterance as opposed to its phonetic representation.

phoneme

The smallest sound unit that distinguishes one word from another. For example, the difference between the words "hat" and "bat" lies in the opposition between the phonemes h and b.

phonetic transcription

A representation of a spoken utterance in which each symbol corresponds to one sound or phoneme.

phrase

A message unit without open slot.

pitch

Highness or lowness of a sound, depending on the vibration of the vocal cords.

prosodic module

Software module which is used to calculate the prosody for an argument to be filled in in an open slot.

prosody

The whole of elements that are related to the melody and rhythm of speech:intonation and duration.

prosody transplantation

A technique that extracts an. phonetico-prosodic parameters, and in particular enriched phonetic transcription from a recording of an utterance.

What is claimed is:

1. An improved apparatus for generating a spoken message of the type employing a recording of the message spoken by a human voice, the recording being parsed into at least one carrier, each carrier having at least one fixed part and at east one open slot, an argument being inserted into each open slot, wherein the improvement comprises:

a. a phonetico-prosodic parameter generator operating on the recording with prosody transplantation techniques for characterizing the message in terms of phonetico-prosodic parameters;

b. an electronic memory for storing phonetico-prosodic parameters corresponding to each carrier;

c. a controller for constructing sequences of phonetico-prosodic parameters corresponding to the argument of each open slot;

d. a phonetics-to-speech converter for generating a digital sound wave pattern from the sequences of phonetico-prosodic parameters;

e. a D/A converter for generating an analog sound wave pattern from the digital sound wave pattern; and f. an output unit for providing audible sound waves corresponding to the analog sound wave pattern.

2. An apparatus according to claim 1, further comprising an input device for reading an argument in orthographic or phonetic text format.

3. An apparatus for electronically generating a spoken message from phonetico-prosodic parameters, the spoken message having at least one carrier, each carrier having at least one fixed part and at least one open slot, an argument being inserted into each open slot, the apparatus comprising:

a. a first controller for selecting at least one carrier to form the spoken message;

b. an electronic memory for storing phonetico-prosodic parameters derived from a recording using prosody transplantation techniques, said parameters corresponding to each carrier;

c. a second controller for constructing sequences of phonetico-prosodic parameters corresponding to the argument of each open slot;

d. a phonetics-to-speech converter for generating a digital sound wave pattern from the sequences of phonetico-prosodic parameters and each selected carrier;

e. a D/A converter for generating an analog sound wave pattern from the digital sound wave pattern; and f. an output unit for providing audible sound waves corresponding to the analog sound wave pattern.

* * * * *

UNITED STATES PATENT AND TRADEMARK OFFICE

CERTIFICATE OF CORRECTION

PATENT NO. : 5,727,120

DATED : March 10, 1998

INVENTOR(S) : Van Coile et al.

It is certified that error appears in the above-identified patent and that said Letters Patent is hereby corrected as shown below:

Column 10, line 23, change "east" to --least--

Signed and Sealed this

Sixteenth Day of June, 1998

*Attest:*

*Attesting Officer*

BRUCE LEHMAN

*Commissioner of Patents and Trademarks*